United States Patent [19]

Debaigt

[11] 4,197,440

[45] Apr. 8, 1980

[54] PUSH BUTTON MECHANISM FOR CONTROLLING A CONTACT UNIT

[75] Inventor: Jean Debaigt, Maisons Laffitte, France

[73] Assignee: CGEE Alsthom, Levallois-Perret, France

[21] Appl. No.: 4,559

[22] Filed: Jan. 18, 1979

[30] Foreign Application Priority Data

Feb. 2, 1978 [FR] France ..... 78 02915

[51] Int. Cl.[2] ..... H01H 9/20; H01H 3/00; H01H 13/56

[52] U.S. Cl. ..... 200/324; 200/153 T; 200/160; 200/328; 200/340

[58] Field of Search ..... 200/153 T, 340, 324, 200/328, 330, 159 R, 160

[56] References Cited

U.S. PATENT DOCUMENTS

| | | | |
|---|---|---|---|
| 2,466,910 | 4/1949 | Pomerantz | 200/160 |
| 3,274,354 | 9/1966 | Stevens | 200/76 |
| 3,378,662 | 4/1968 | Sorenson | 200/324 X |
| 3,674,970 | 7/1972 | Bedocs | 200/340 X |
| 3,949,179 | 4/1976 | Bauer | 200/328 X |
| 4,097,703 | 6/1978 | Houser | 200/328 X |

FOREIGN PATENT DOCUMENTS 2322442 3/1977 France .

*Primary Examiner*—Steven M. Pollard
*Attorney, Agent, or Firm*—Roland Plottel

[57] ABSTRACT

A push button mechanism includes a housing (1) including a push button control key (2) and microswitches (4) actuated by pushing the key. There are two common modes of push button operation: either a non-locking operation in which the position of the switch contacts corresponds to the position of the key; or a locking operation in which pushing the key changes the position of the switch which then remains in the new position after the key is released. From the manufacturing point of view it is desireable to provide a single mechanism which can act in either mode depending on the position of a selection component (7). From the user's point of view it may be advantageous to be able to change the mode of a switch which is already installed and wired. The present invention provides an operating key which may be withdrawn from the mechanism through the end face of the housing. The key carries a selection finger (7) for actuating a locking mechanism (8). For non-locking operation the finger is turned into a recess in the key while for locking operation it projects forwardly of the key. When the key is withdrawn it is simple to change the position of the finger.

3 Claims, 3 Drawing Figures

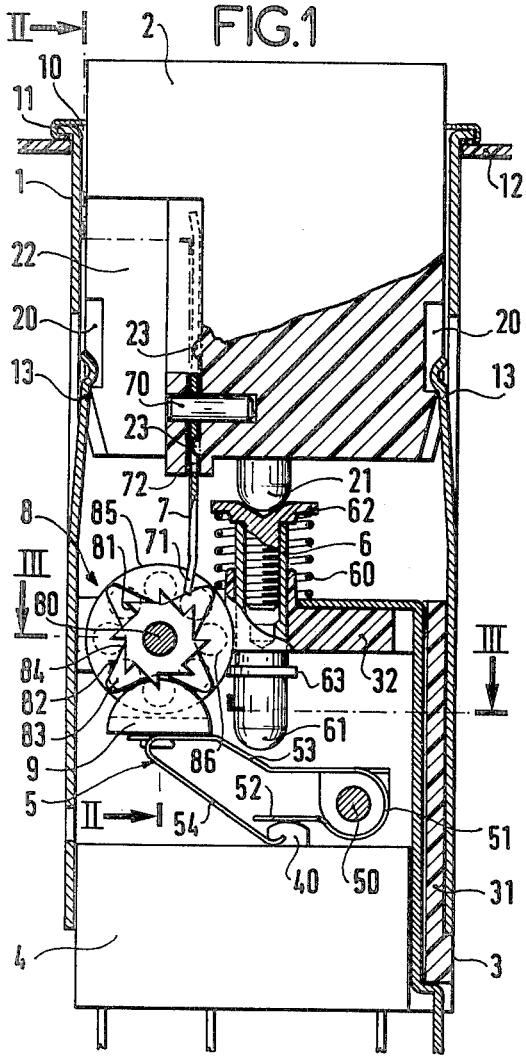
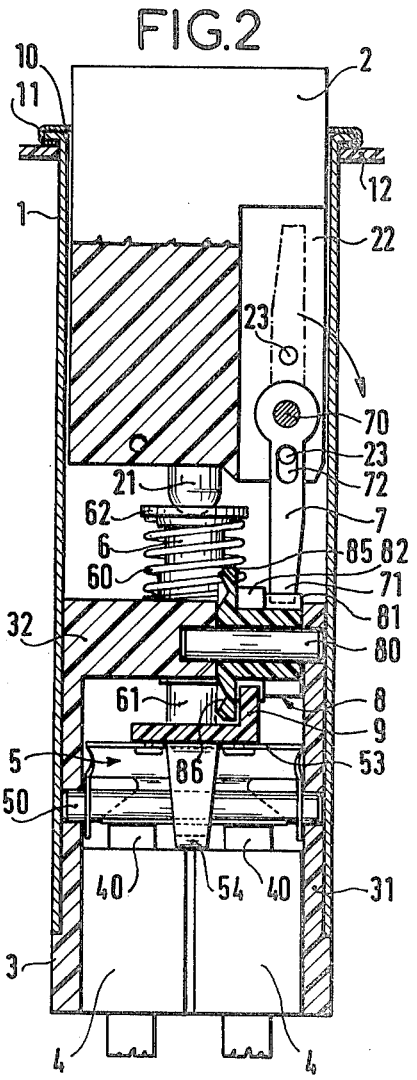
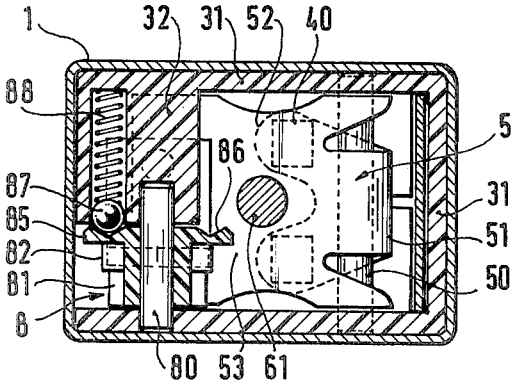
FIG.3

PUSH BUTTON MECHANISM FOR CONTROLLING A CONTACT UNIT

The invention relates to a push button mechanism for controlling an electric contact unit, the push button having a rest position and an operating position.

Push buttons mechanism currently used for controlling contact units are generally of two types, providing either non-locking push buttons, where the controlled unit returns freely to its rest position, or else locking push buttons where the controlled unit remains locked in its operating position subsequent to a control operation until a further control operation releases the locked unit to allow it to resume its rest position.

Therefore an effort has quite naturally been made to try to provide a single mechanism which can optionally perform in either of these two modes by positioning a selection component appropriately. Hence, the mechanism described in French patent application No. 2,322,422 is capable of non-locking or of locking operation. However such a mechanism requires the mode of operation to be chosen before installation and wiring of the push button on a control panel or switch board, since once installed, the operation selection component is practically inaccessible and it is not easy to change from one mode of operation to the other. Therefore, it has been essential to determine the positioning of the selection component corresponding to the required mode before the equipment is assembled.

The invention aims to provide a push button mechanism in which the selection component is accessible for positioning, even after installation and wiring on a control panel or switch board, so as to make it possible to modify its mode of operation at any time.

The invention provides a push button mechanism comprising a casing containing a control key for controlling a push rod which actuates a controlled contact unit, said contact unit having a rest position and an operating position, said key being disposed slidably through one of the faces of the casing, and being fitted with a selection component for selecting the manner in which the control key acts on the controlled contact unit, said selection component having a first position corresponding to a direct, non-locking action and a second position corresponding to a locking action, characterized in that the control key is removable through the said one of the faces of the casing and includes, in its periphery, a recess in which the selection component is disposed, the recess including an axis about which the selection component is pivotable to move between its first and second positions, and the recess with the selection component being accessible when the control key is removed from the casing.

Preferably the push button mechanism includes a resilient fixing device for fixing the control key on the casing.

The selection component may be constituted by a finger which, in the second position engages a ratchet wheel which is integral with a cam wheel which comprises a succession of as many ridges and hollows as there are pairs of teeth on the ratchet wheel, the ridges controlling locking of the controlled unit in the operating position and the hollows releasing the controlled unit.

The characteristics and advantages of the invention will become apparent from the description given hereinbelow of one embodiment given by way of example with reference to the accompanying drawing, in which:

FIG. 1 is a section in elevation of a push button mechanism in accordance with the invention;

FIG. 2 is a cross-section along II—II of FIG. 1; and

FIG. 3 is a cross-section along III—III of FIG. 1.

In the figures, a metal casing is designated by the reference numeral 1. A control key 2 is slidably disposed in an opening 10 in the front face of the metal casing, said front face corresponding to the upper parts of FIGS. 1 and 2. The opening 10 has a rim 11 which presses against the edges of an aperture formed in a support 12 constituted by a control panel.

The control key 2 is removable from the front face of the casing in which it is held by resilient tabs 13 cut out of the side surfaces of the casing and co-operating with slots 20 in the sides of the key.

A base 3 is fitted inside the casing 1 through its rear and comprises side walls 31 which extend along the casing 1 and a transversal wall 32 facing the control key. Two micro-switches 4 (each of which has its own control push rod 40) are disposed inside the base 2, between its side walls 31.

The position of the push rods 40, which constitute the control components, depends on a spring 5 which comprises a loop 51 hinged about an axle 50 disposed between the side walls 31 of the bottom 3. On its rear facing side, the spring 5 has two small end strips 52 which are eccentric and disposed against respective push rods 40 and, on its front facing side it has a central strip 53 which has a resilient tongue 54 at its end curving round so as to bear slidably along the front facing wall of the micro-switches 4.

The central strip 53 of the spring 5 is controlled by the rear end 61 of an intermediate push rod 6 whose front end 62 is controlled by a control stub 21 disposed on the rear face of the control key 2.

The intermediate push rod 6 is fixed through the wall 32. A compression spring 60 is disposed between a rim at its end front 62 and the front surface of the wall 32, while near its rear end 61 there is a positioning collar 63 abutting against the rear facing surface of the wall 32, so that the spring 60 tends to return the key 2 to the rest position by acting on the control stub 21.

In the side of the control key 2 there is a longitudinal recess 22 in which is disposed a finger 7 rotatable about a transversal axle 70.

The recess 22 is constituted by a hollowed out part such that the finger 7 can occupy one position in which it is disposed parallel to the intermediate push rod 6, its end 71 being placed facing a ratchet wheel 81 and another position, shown in chain-dotted lines, in which the finger 7 is disposed inside the recess 22 in the opposite direction to that of the first position. Lugs 23 in the recess 22 which co-operate with a slot 72 in the finger 7 make it possible to maintain the latter in one of these positions or the other.

The ratchet wheel 81 forms a part of a mechanism 8 which further includes a cam wheel 82 which comprises a succession of as many ridges 83 and hollows 84 as there are pairs of teeth on the ratchet wheel and a positioning disc 85 which includes on its inner side as many cavities 86 as there are teeth on the ratchet wheel 81. The mechanism 8, which is placed in a recess transveral to the partition 32 rotates on an axle 80 disposed in the recess, parallel to the partition 32. Each of the cavities 86 co-operates successively as a function of the position of each of the teeth of the ratchet wheel 81 with a ball 87 urged by a compression spring 88 which is disposed parallel to an axle 80, so as to lock the mechanism in the position which corresponds to the cavity which contains the ball.

A cam follower 9 in the form of a semi-circular disc is supported on the central strip 53 of the spring 5 and co-operates alternately with the ridges 83 and the hollows 84 of the cam wheel 82.

Therefore, the push button operates as follows.

When the push button operation selection unit, constituted by the finger 7, occupies a first position which corresponds to that shown in dashed lines in FIG. 1 and in chain-dotted lines in FIG. 2, and the cam follower 9 is positioned in a hollow 84 of the cam wheel 82, then operating the control key pushes the intermediate push rod 6 against the strip 53 of the spring 5 which rotates on its axle 50. Each of the strips 52 then operates the control unit constituted by the push rod 40 of one of the micro-switches. However, as soon as the key 2 is released, the spring 60 returns the intermediate push rod 6 as well as the key 2 to the rest position; this releases the push rod 40. Hence, each time the control key 2 is pushed, the push rod 40 is also pushed, but without being locked.

If, on the contrary, it is required to provide locking control on the push rod 40, it is necessary only to place the operation selection unit (i.e. the finger 7) of the push button in the second position which corresponds to the solid lines in FIGS. 1 and 2. To do this, the control key 2 is pulled so as to release the resilient tongues 13 from the slots 20, whereby the key is removed from the casing 1 through the front face thereof. Then the finger 7 is rotated through 180° and the control key is put back in place in the casing. In this position, when the control key 2 is operated, it moves the end 71 of the finger 7 into the ratchet wheel 81; this rotates the mechanism through an angle which corresponds to the tooth pitch, so that a ridge 83 takes the place of a hollow 84 which was in contact with the cam follower 9. As previously, the intermediate push rod 6 operates the push rod 40 which is controlled by means of the spring 5 to return to the rest position when the control key is no longer actuated. However, the spring 5 remains in the operating position due to the fact that the cam follower 9 is engaged against the ridge 83 of the cam wheel 82. This keeps the push rod 40 in a locked control position. Therefore, to release the push rod 40, the button 2 must again be actuated so that by operating the ratchet wheel 81, the end 71 of the finger 7 will move the ridge 83 out of contact with the cam follower 9 and replace it by a hollow 84, thereby releasing the spring 5.

It is also seen that the change from one mode of operation of the push button to another is easy even when the push button is installed and wired on a control panel, by positioning a selection unit disposed on the detachable control key.

I claim:

1. A push button mechanism comprising a casing containing a control key for controlling a push rod which actuates a controlled contact unit, said contact unit having a rest position and an operating position, said key being disposed slidably through one of the faces of the casing, and being fitted with a selection component for selecting the manner in which the control key acts on the controlled contact unit, said selection component having a first position corresponding to a direct, non-locking action and a second position corresponding to a locking action, characterized in that the control key is removeable through the said one of the faces of the casing and includes, in its periphery, a recess in which the selection component is disposed, the recess including an axis about which the selection component is pivotable to move between its first and second positions, and the recess with the selection component being accessible when the control key is removed from the casing.

2. A push button mechanism according to claim 1, characterized in that it includes a resilient fixing device for fixing the control key on the casing.

3. A push button mechanism according to claim 1 or 2, characterized in that the selection component is constituted by a finger which, in said second position engages a ratchet wheel which is integral with a cam wheel which comprises a succession of as many ridges and hollows as there are pairs of teeth on the ratchet wheel, the ridges controlling locking of the controlled unit in the operating position and the hollows releasing the controlled unit.

* * * * *